United States Patent [19]

Miyoshi

[11] Patent Number: 4,655,072

[45] Date of Patent: Apr. 7, 1987

[54] CLAMP

[75] Inventor: Makoto Miyoshi, Tondabayashi, Japan

[73] Assignee: Sanko Kinzoku Co., Ltd., Osaka, Japan

[21] Appl. No.: 798,087

[22] Filed: Nov. 14, 1985

[51] Int. Cl.[4] ..... B21D 1/12

[52] U.S. Cl. ..... 72/422; 24/335; 72/705; 403/385

[58] Field of Search ..... 72/422, 705; 248/229; 24/535, 569, 335, 336; 403/309, 344, 385, 389, 395, 397

[56] References Cited

U.S. PATENT DOCUMENTS

| | | | |
|---|---|---|---|
| 1,478,896 | 12/1923 | Ferency | 403/397 |
| 2,606,467 | 8/1952 | Desjarlais et al. | 72/705 |
| 3,222,022 | 12/1965 | Akin, Jr. | 248/229 |
| 3,505,761 | 4/1970 | Prieur | 248/229 |
| 4,109,888 | 8/1978 | Hayes | 248/229 |

FOREIGN PATENT DOCUMENTS

| | | | |
|---|---|---|---|
| 3728 | 2/1905 | France | 403/344 |

*Primary Examiner*—Lowell A. Larson
*Attorney, Agent, or Firm*—Griffin, Branigan, & Butler

[57] ABSTRACT

A clamp includes an elastic member which comprises a generally U-shaped tube portion, two recessed portions which separately extend from the tube portion and are curved inwardly, and two gripping portions which extend from the respective recessed portions, two opposing clamp teeth each of which is mounted on the inner face of a respective gripping portion, and a fastener which urges the two gripping portions toward each other for tightening and contracting the tube portion and at the same time driving the two clamp teeth toward each other. An elongated pipe-like member runs through the tube portion of the elastic member. A portion of a damaged automobile is positioned between the two opposing clamp teeth, and then the gripping portions are tightened by the fastener so that as the elastic member of the clamp is secured on the elongated member a portion of a vehicle is gripped tightly between the clamp teeth. The clamp is particularly useful on an auto lock clamp apparatus of the type used to secure and horizontally support an automobile while body repairs are being made.

8 Claims, 10 Drawing Figures

CLAMP

FIELD OF THE INVENTION

The present invention relates to improvements in the clamp used on, for instance, an auto lock clamp apparatus, the auto lock clamp apparatus being used to horizontally support and tightly grip an automobile or other vehicle during the repair of body damage such as might be incurred in an automobile accident.

BACKGROUND OF THE INVENTION

When repairing body damage to an automobile or similar vehicle, it is frequently necessary to immovably secure the vehicle since dented portions thereof need to be pulled out to their original shapes. Also contorted portions of the vehicle frame may need to be repaired using various kinds of tools and machines.

There exists in the prior art an auto lock clamp apparatus for horizontally supporting and securing a vehicle while body repairs are made. A typical apparatus includes stands, support bars, clamps, and chains as well as base plates which must be attached to the floor of the garage. The clamps typically comprise many parts including a plurality of bolts or other fastening means which must be individually tightened against coiled bias springs in order to move opposed clamping teeth into gripping engagement with a portion of the automobile body. Thus, the prior art device is costly, difficult to use, and requires considerable time to set up.

SUMMARY OF THE INVENTION

An object of the present invention is to provide a clamp which is less costly, requires fewer parts, and is easier to use than conventional clamps.

An object of the present invention is to provide a clamp which may be secured on an elongated member, such as a pipe, and a portion of a vehicle gripped by the clamp, both operations being accomplished by tightening a single fastening means with the result that the vehicle can be speedily and easily immovably supported.

It is a further object of the invention to provide a clamp which can firmly, and with certainty, grip a vehicle.

In order to achieve the above stated objectives, the clamp according to the present invention includes an elastic means which comprises a roughly U-shaped tube portion, two recessed portions which extend separately from the tube portion and are curved inwardly, and two gripping portions each of which extends from the respective recessed portions; two opposing clamp teeth each of which is mounted on the inner face of a respective gripping portion; and a fastening means which fastens the gripping portions to simultaneously tighten and contract the tube portion and drive or urge the two opposing clamp teeth toward each other. The elastic means is secured on an elongated member such as a pipe, which is immovably placed horizontally, in such a manner that the elongated member runs through the tube portion of the elastic means. A portion of the body of a damaged vehicle is positioned between the two opposing clamp teeth. The gripping portions are then tightened by the fastening means with the result that the elastic means of the clamp is secured firmly on the elongated member and, simultaneously, the portion of the body of the vehicle is gripped between the clamp teeth.

According to the clamp of the present invention, when the gripping portions of the elastic means are tightened, the tube portion of the elastic means is contracted to grip the elongated member and at the same time the clamp teeth grip a portion of the damaged vehicle with the result that the automobile is easily and speedily immovably fixed. Further, when the fastening means is loosened, the elasticity of the elastic means allows the tube portion to be enlarged and, at the same time, permits the clamp teeth to move away from each other.

Other objects and advantages of the invention, and its mode of operation, will become apparent upon consideration of the following description and the accompanying drawing.

DETAILED DESCRIPTION OF THE INVENTION

Figure 10:
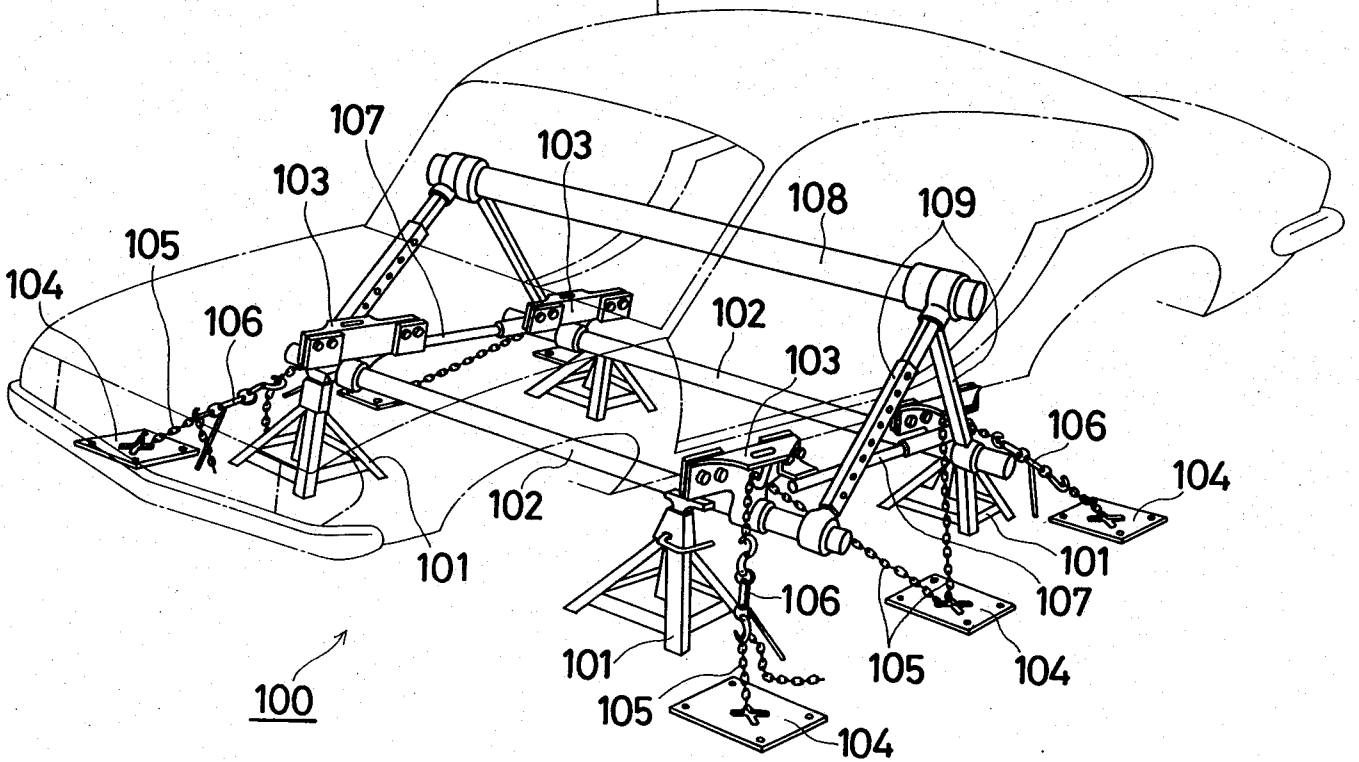
FIG. 10 (PRIOR ART)
FIG. 10 is a perspective view of an auto lock clamp apparatus utilizing a conventional clamp.

FIG. 10 shows a conventional auto lock clamp apparatus of the prior art for supporting and gripping a damaged automobile or similar vehicle 115. The conventional auto lock clamp apparatus 100 comprises a plurality of stands 101, clamp pipes 102 which are supported in the horizontal state by the stands 101, clamps 103 mounted on the clamp pipes 102, base plates 104 fastened immovably on the floor, chains 105 which link the clamps 103 and the base plates 104 so that the clamps 103 are secured immovably on the clamp pipes 102, chain locks 106 which engage the chains 105, connection bars 107 which link two clamps 103, a center pipe 108, and support bars 109 which link the clamp pipes 102 and the center pipe 108. The clamps 103 grip a portion, for instance the rocker panel, of the vehicle so that the vehicle is immovably supported in the horizontal state.

Figure 7:
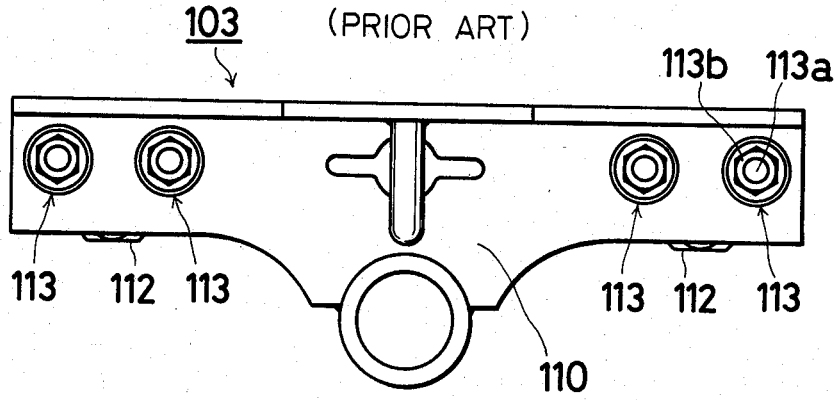
FIG. 7 (PRIOR ART)
FIG. 7 is a front view of a conventional clamp of the prior art.
Figure 8:
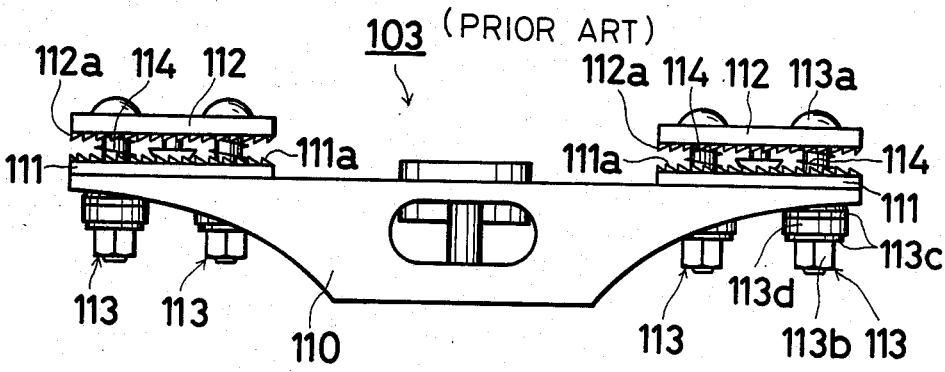
FIG. 8 (PRIOR ART)
FIG. 8 is a top view of the conventional clamp.
Figure 9:
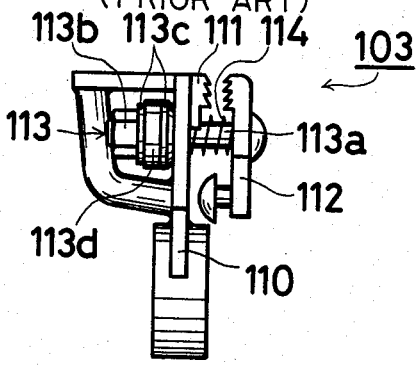
FIG. 9 (PRIOR ART)
FIG. 9 is a right side view of the conventional clamp.

The conventional clamp 103 employed on the auto lock clamp apparatus 100 comprises, as shown in FIGS. 7 to 9, a main body 110 mounted on the clamp pipe 102, clamp teeth 111 which are mounted on the main body 110 and have a plurality of protrusions 111*a* thereon, movable plates 112 each of which is located opposite a clamp tooth 111 and has a plurality of protrusions 112*a* thereon, and a plurality of fastening means 113 each of which runs through the main body 110, the clamp tooth 111 and the movable plate 112. Each fastening means comprises a bolt 113*a*, a nut 113*b*, a washer 113*c* and a thrust bearing 113*d*. A coil spring 114 surrounds each bolt 113*a* between the main body 110 and the movable plate 112 and presses the main body and the movable plate in opposite directions. The rocker panel of the vehicle 115 is placed between the clamp tooth 111 and the movable plate 112 and is gripped therebetween by tightening the fastening means 113 against the pressure of the spring 114.

In order to use the conventional clamp 103 it must first be immovably secured on the clamp pipe 102 by linking the clamp 103 and the base plate 104 with the chain 105. Next, the fastening means 113 is tightened to move the movable plate 112 toward clamp tooth 111 thereby gripping a portion of the automobile body. Consequently, with the conventional clamp 103 a two-step process is required which cannot be speedily and easily carried out.

The clamp 103 requires springs 114 each of which is positioned between and always presses the clamp tooth 111 and the movable plate 112 in opposite directions to provide a space therebetween so that the rocker panel of the vehicle may be easily positioned between the clamp tooth 111 and the movable plate 112. Also, the chains 105 and the base plates 104 are needed to immovably secure the clamp 103 on the clamp pipe 102. Since the conventional clamp 103 needs the springs 114, chains 105, and base plates 104, it is costly.

Furthermore, the clamp 103 needs at least two fastening means 113 which run through both the main body 110 and the movable plate 112 to prevent the movable plate 112 from rotating, that is, from slipping out of a desired position where the protrusion portion of the movable plate 112 and the protrusion portion of the clamp tooth 111 take opposing positions. If all the plural fastening means 113 of the clamp 103 are not tightened to the same degree, the clamp cannot grip the rocker panel with equal (uniform) strength at the places of the plural fastening means 113. Consequently, there is a problem in using clamp 103 in that the rocker panel might not be gripped with certainty. Also, it is troublesome to tighten all the plural fastening means 113.

Further, the clamp 103 has the movable plate 112 attached to the main body 110 with some space being provided between the main body 110 and each movable plate 112 with the result that the clamp 103 is bulky.

Referring now to FIGS. 1–6, a clamp 1 constructed in accordance with the principles of the present invention comprises an elastic or resiliently flexible means 2, two clamp teeth 3 mounted on the elastic means 2 and a fastening means 4 which tightens the elastic means 2.

The elastic means 2 is made by bending steel material to a desired shape and comprises a roughly U-shaped tube-like portion **2*a*, two recessed portions 2*b* which separately extend from the tube portion 2*a* and are curved inwardly, and two gripping portions 2*c* each of which extends, in turn, from a respective recessed portion 2*b*. The tube-like portion 2*a* is roughly shaped to permit an elongated member such as a polygonal pipe 5 to extend therethrough. The pipe 5** is preferably substantially square in cross-section but may, instead, be a tube pipe or bar of circular cross-section.

The elasticity or resilient flexibility of the elastic means 2 enables the tube portion **2*a* to be considerably contracted or enlarged and, correspondingly, makes the two gripping portions 2*c* move close to or away from each other. As used herein, the terms "elastic" and "resiliently flexible" connote that the material from which means 2 is fabricated exhibits the characteristic that it tends to return toward its initial state upon the release or easing of a force which urges the gripping portions 2*c*** toward each other.

Each clamp tooth 3 has a plurality of protrusions **3*a* on the face thereof, and each clamp tooth is mounted on and secured to a gripping portion 2*c* by bolts 6 in such a manner that the protrusions 3*a* on one clamp tooth 3 are positioned opposite the protrusion 3*a* on the other clamp tooth. It is needless to say that the clamp teeth 3 can also be fixed on the gripping portions 2*c* by welding or the like, instead of the bolts 6**.

The fastening means 4 runs through the opposing two gripping portions **2*c* of the elastic member 2 and functions to contract the tube portion 2*a* and to drive the two opposing clamp teeth 3 close to each other. In the preferred embodiment, the fastening means 4 comprises a bolt 4*a*, a nut 4*b*, a washer 4*c* and a thrust bearing 4*d***.

Figure 1:
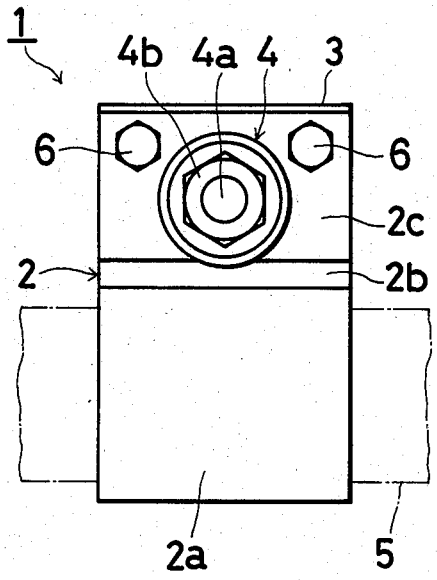
FIG. 1 is a front view of a clamp constructed in accordance with the principles of the present invention.
Figure 2:
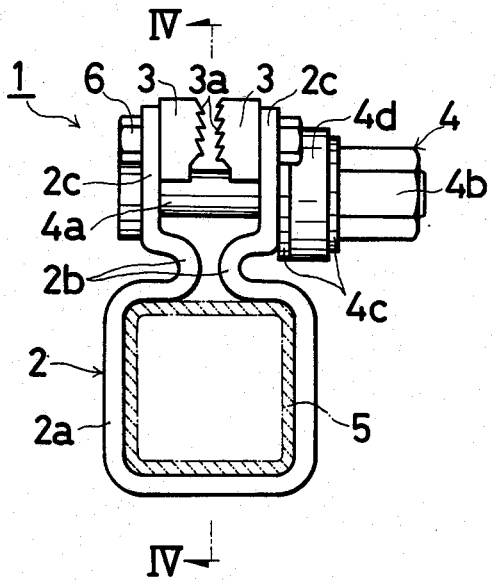
FIG. 2 is a left side view of the clamp.
Figure 3:
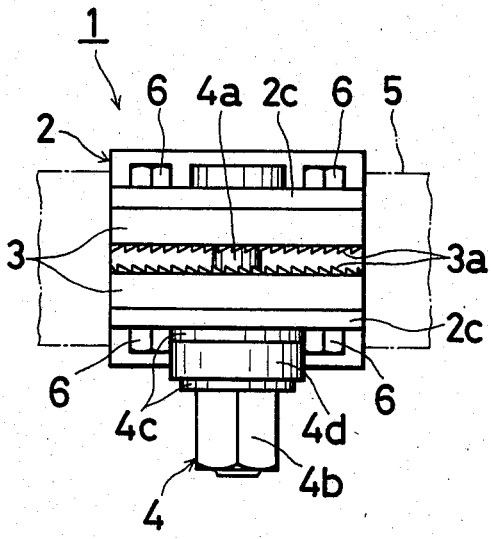
FIG. 3 is a top view of the clamp.
Figure 4:
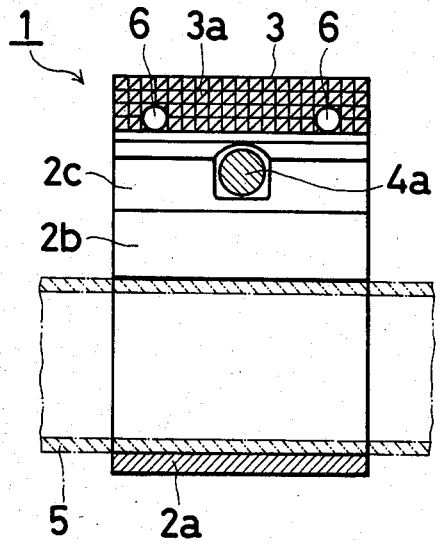
FIG. 4 is a sectional view taken along the line IV—IV of FIG. 2.

The fastening means 4 is not limited to the specific arrangement shown in FIGS. 1 and 2. Any fastening means can be employed as long as it is capable of moving gripping portions **2*c*** toward each other.

When the gripping portions **2*c* of the elastic means 2 are tightened or compressed toward each other by the fastening means 4, the tube portion 2*a* is reduced (contracted) and firmly grips the elongated member 5. At the same time, the opposing two clamp teeth 3 are driven toward each other so as to grip that portion of a vehicle (e.g. the rocker panel) which has been positioned between the clamp teeth 3**.

Figure 5:
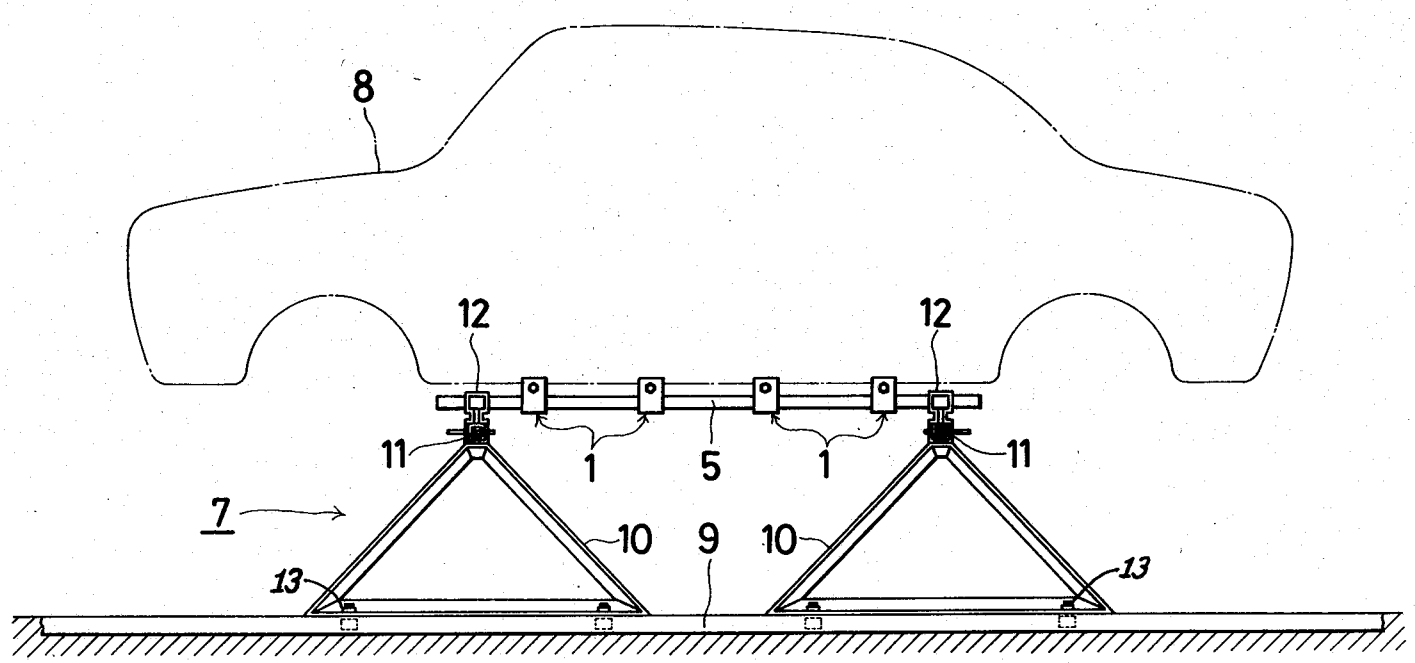
FIG. 5 is a front view of an auto lock clamp apparatus employing the clamp of the present invention.
Figure 6:
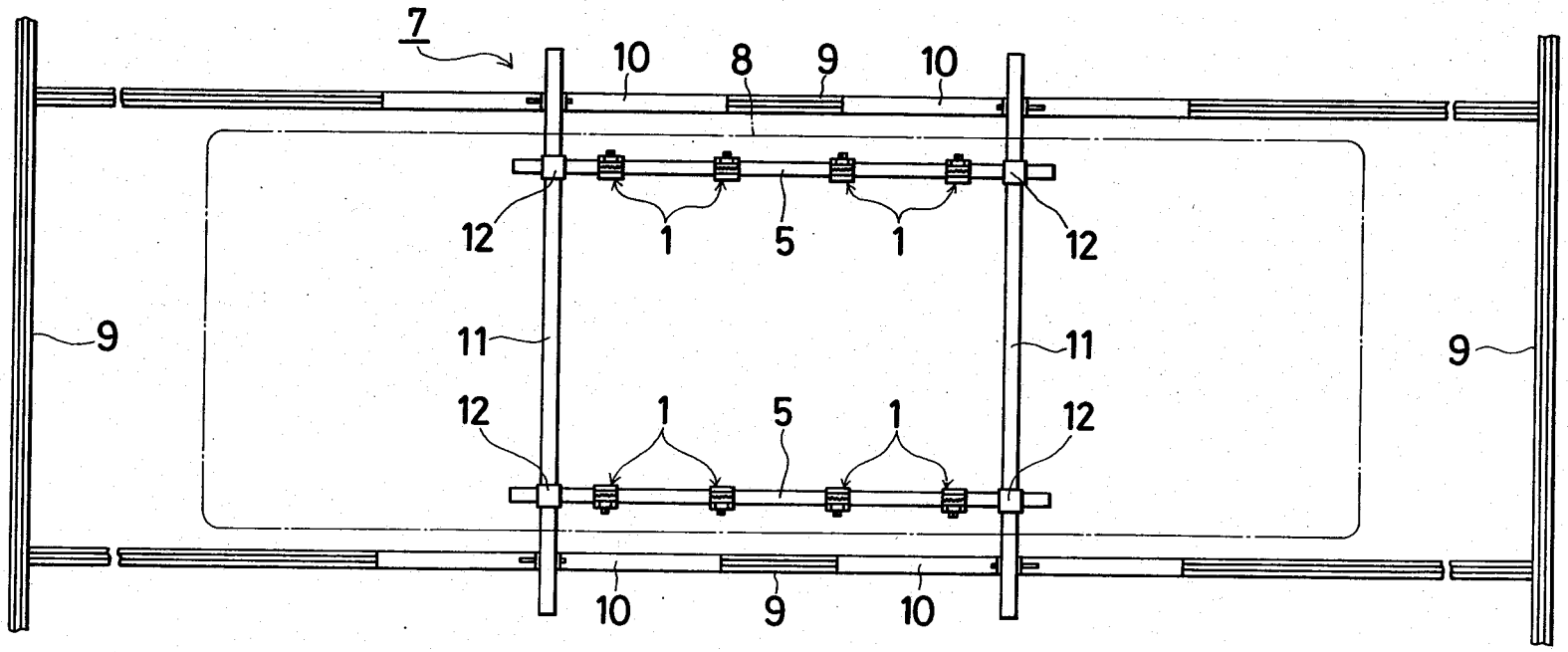
FIG. 6 is a top view of the auto lock clamp apparatus of FIG. 5.

The improved clamp permits the use of a much simplified auto lock clamp apparatus 7 as illustrated in FIGS. 5 and 6. The auto lock clamp apparatus 7 comprises a plurality of rails 9 each of which has an elongated groove thereon and is rectangular in crosssection, the rails 9 being buried and firmly secured at appropriate locations on the floor, a plurality of stands 10 which are movably mounted on the rails 9 and can be secured to desired positions of the rails 9 by fastening means 13, a pair of support bars 11 which are rectangular in cross-section and are removably secured to and supported horizontally by the stands 10, and a pair of elongated members 5 which are also rectangular in cross-section and are supported horizontally by the support bars 11 in such a manner that the elongated members 5 are positioned at a right angle in relation to the support bars 11. Joints 12 are mounted on support bars 11. Support bars 11 and elongated members 5 slidably run through and are secured to joints 12. A plurality of clamps 1 are slidably mounted on the elongated members 5.

Assuming that a damaged portion of a vehicle is to be restored to its original shape, the stands 10 are positioned along rails 9 and the fastening means 13 tightened. A part of the vehicle 8, for instance the rocker panel, is placed between the opposing clamp teeth 3 of clamps 1 and the gripping portions **2*b* are tightened by the fastening means 4. As a result, the tube portion 2*a* is tightened and contracted and grips the elongated member 5, and at the same time the two opposing clamp teeth 3 are urged close to each other for gripping the rocker panel with the result that the damaged vehicle 8** is secured and supported horizontally.

When gripping and supporting the vehicle, the protrusions **3*a* on the clamp teeth 3 and, hence, the gripped rocker panel are located above the axis of the tube portion 2*a*, that is, the elongated members 5, so that the vehicle 8** is supported with balance and, hence, with firmness.

When the fastening means 4 is loosened, the elasticity or flexible resilience of the elastic means 2 allows the tube portion **2*a* to be enlarged thereby facilitating both the removal and insertion of the elongated member 5 through the tube portion 2***a*.

Further, when the tube portion 2*a* is enlarged with the fastening means 4 being loosened, the two opposing clamp teeth 3 are positioned apart from each other for providing a substantial space between the clamp teeth 3, thereby facilitating placement of the rocker panel of the vehicle between the two opposing clamp teeth 3.

Since the fastening means 4 includes the thrust bearing 4*d*, the tightening torque is increased, thus facilitating the tightening operation.

From the foregoing description it is seen that the clamp of the present invention does not require springs to urge the clamp tooth and movable plate in opposite directions, as is required in the clamps of the prior art, hence it requires fewer parts and is less likely to fail.

Furthermore, the improved clamp, because it grips the elongated member 5 in the same movement which causes the gripping of the vehicle part between the clamp teeth, assures that the gripped part is located approximately or even exactly above the axis of the elongated member. This assures that the weight of the vehicle is evenly balanced and supported thereby permitting a firm and certain clamping of the vehicle part.

Since the present invention has a single fastening member 4 for tightening the gripping portions of the elastic means, the operator does not have to tighten a plurality of fasteners and does not have to be concerned with obtaining uniform tightness of gripping over the gripping area.

Although, with the above-described embodiment, the clamp 1 is employed on the auto lock clamp apparatus 7, it is needless to say that utilization of the clamp 1 is not confined to such use. Furthermore, various substitutes and modifications may be made in the described embodiment without departing from the spirit and scope of the invention as defined by the appended claims.

The embodiment of the invention in which an exclusive propertly or privilege are claimed are defined as follows:

1. A clamp for being activated to simultaneously grip a horizontal elongated supporting member and upright other members of various thicknesses, located above said elongated supporting member, said clamp comprising:

an elastic metallic band being bent to form a roughly U-shaped tube portion for enclosing three sides of said elongated member, two inwardly protruding recessed portions separately bent inwardly from the tube portion to thereby form shoulders for partially enclosing a portion of a fourth side of said elongated member, and being bent outwardly to two gripping portions, thereby separating inner faces of outer ends of the gripping portions, wherein said tube portion and said two recessed portions of said elastic means form a substantial square shape for snugly receiving an elongated, substantially square in cross-section, member which may be slidably inserted through the tube portion;

two opposing clamp teeth mounted on the inner face of the gripping portions of the elastic means; and, a fastening means for engaging said gripping portions between said opposing clamp teeth and said recessed portions for forcing the two gripping portions toward each other to thereby contract the tube portion and, simultaneously, force the opposing two clamp teeth toward each other;

whereby, as said tube portion is made to contract onto and grip said elongated member by said fastening means said gripping portions are caused to simultaneously close said opposing clamp teeth for gripping said other member so that said elongated member can support said other member upright in relation to said elongated member when said elongated member is substantially horizontal.

2. A clamp as claimed in claim 1 wherein a plurality of protrusions are provided on the inner surface of the two opposing clamp teeth.

3. A clamp as claimed in claim 2 wherein the protrusions on the clamp teeth are positioned above a central axis of the tube portion of the elastic means when the clamp teeth are urged to close to each other by the fastening means and said elongated member is substantially horizontal.

4. A clamp as claimed in claim 1 wherein the protrusions on the clamp teeth are positioned substantially directly above a central axis of the tube portion of the elastic means when the clamp teeth are urged to close to each other by the fastening means and said elongated member is substantially horizontal.

5. A clamp as claimed in claim 1 wherein said fastening means comprises a single fastener.

6. A clamp as claimed in claim 1 wherein the fastening means comprises a bolt, a nut, a washer and a thrust bearing.

7. A clamp as claimed in claim 1 wherein said elastic means comprises a shaped piece of resiliently flexible material, whereby said tube portion expands and said gripping portions move away from each other when said fastening means is loosened to reduce the force it exerts on the gripping portions.

8. A clamp as in claim 1 wherein said two gripping portions are positioned in planes approximately parallel to, and passing through, said elongated member and said other member gripped by said clamp is centered on the axis of said elongated member.

* * * * *